US007758348B1

(12) United States Patent
Key

(10) Patent No.: US 7,758,348 B1
(45) Date of Patent: Jul. 20, 2010

(54) WORK AND DISPLAY DEVICE AND METHOD

(76) Inventor: Sandee Matthews Key, 5737 Chrismon Rd., Brown Summit, NC (US) 27214

( * ) Notice: Subject to any disclaimer, the term of this patent is extended or adjusted under 35 U.S.C. 154(b) by 1391 days.

(21) Appl. No.: 11/191,671

(22) Filed: Jul. 28, 2005

(51) Int. Cl.
*B43L 1/00* (2006.01)

(52) U.S. Cl. ..... 434/408

(58) Field of Classification Search ..... 428/40.1; 434/247, 408, 413, 416, 421, 428, 430
See application file for complete search history.

(56) References Cited

U.S. PATENT DOCUMENTS

| | | | | |
|---|---|---|---|---|
| 3,654,711 | A | 4/1972 | Taylor | |
| 3,716,935 | A | 2/1973 | Friedrichs | |
| 4,584,223 | A | 4/1986 | Krapf | |
| 4,652,239 | A | 3/1987 | Brimberg | 434/80 |
| 4,670,794 | A | 6/1987 | Araki et al. | 358/293 |
| 4,741,119 | A | 5/1988 | Baryla | 40/594 |
| 4,996,110 | A | 2/1991 | Tanuma et al. | |
| 5,010,671 | A | 4/1991 | Stonehouse | 40/594 |
| 5,102,171 | A | 4/1992 | Saetre | 283/117 |
| 5,207,581 | A | 5/1993 | Boyd | 434/412 |
| 5,334,431 | A | 8/1994 | Longtin | 428/40 |
| 5,352,535 | A | 10/1994 | Su | 428/511 |
| 5,430,965 | A | 7/1995 | Lai | 40/597 |
| 5,527,568 | A | 6/1996 | Boone et al. | 428/14 |
| 5,573,405 | A * | 11/1996 | Evans | 434/238 |
| 5,622,504 | A * | 4/1997 | Hance | 434/430 |
| 5,682,695 | A | 11/1997 | Hoffman | |
| 5,916,650 | A | 6/1999 | Rosenbaum et al. | 428/40.1 |
| D418,162 | S | 12/1999 | Mazzaglia | |
| 6,251,500 | B1 * | 6/2001 | Varga et al. | 428/195.1 |
| 6,263,602 | B1 | 7/2001 | Seiber et al. | 40/606 |
| 6,308,445 | B1 | 10/2001 | Porraro | 40/594 |
| 6,324,777 | B1 | 12/2001 | Ngan | 40/107 |
| 6,464,507 | B1 * | 10/2002 | Bailey | 434/247 |
| 6,520,543 | B1 | 2/2003 | Hoar | 283/67 |
| 6,660,352 | B2 * | 12/2003 | Hsu et al. | 428/40.1 |
| 6,893,266 | B2 | 5/2005 | Donelan | 434/408 |
| 7,399,184 | B2 * | 7/2008 | Hester et al. | 434/408 |
| 2002/0064762 | A1 * | 5/2002 | Avery et al. | 434/81 |
| 2002/0090480 | A1 | 7/2002 | Hsu et al. | 428/40.1 |
| 2004/0081844 | A1 | 4/2004 | Bharti et al. | 428/523 |
| 2005/0000642 | A1 | 1/2005 | Everaerts et al. | 156/273.1 |
| 2005/0255272 | A1 * | 11/2005 | Query, Jr. | 428/40.1 |
| 2006/0024461 | A1 * | 2/2006 | Gustafson et al. | 428/40.1 |

OTHER PUBLICATIONS

Weather Wall Classroom Hanging Map, http://sciencekit.com; Science Kit and Boreal Laboratories website print out pp. 1-2.

(Continued)

*Primary Examiner*—Kurt Fernstrom
(74) *Attorney, Agent, or Firm*—MacCord Mason PLLC

(57) ABSTRACT

A work and display system and device including a flexible work support, a static cling material attached to the flexible work support having permanent markings on one side, and a coating having an outer surface for erasable marking. A work and display method.

2 Claims, 7 Drawing Sheets

OTHER PUBLICATIONS

Write On-Cling Perforated Poly Static Sheets manufactured by National Brand; http://www.cleansweepsupply.com website printout p. 1.
Write On/Wipe Off Static Cling Presentation Sheets marketing flyer put out by Perfect Print for Nashua Corp. p. 1.
Write-On Poly Sheets Instant Whiteboards by Insta Wares; website print out from Kevin Kelly Cool Tools at http://www.kk.org/cooltools/archives/000700.php; p. 1.
Rediform Write-On Cling Sheets Sam's Club website print out at http://www.samsclub.com; pp. 1-2.

* cited by examiner

WORK AND DISPLAY DEVICE AND METHOD

BACKGROUND OF THE INVENTION

The present disclosure relates generally to a work and display device. Although chalkboards and whiteboards have been used for such things as classroom instruction, these prior art devices are generally limited in size to something matching the viewable area on the walls at of a classroom or the like. Thus, a limited amount of information can be displayed on such a board before the at least some of the information must be removed from the board to present additional information. A sheet of paper or even a static cling decal can be used to supplement information but the prior art has heretofore not provided a versatile work and display device that can be used on a desktop, provides for convenient transport to a classroom and storage, is marked with permanent graphics to aid instruction, and provides a surface for dry erase marking. Thus, there is a need for such a work and display system, device for use with the system, and method of using such a system.

SUMMARY OF THE INVENTION

The disclosure describes a work and display device including a flexible work support, a static cling material attached to the flexible work support having permanent markings on one side, and a coating having an outer surface for erasable marking.

The disclosure also provides a work and display system including a horizontal work surface, a marker, a whiteboard, and a work and display device. The work and display device includes a flexible work support having a smooth surface slidable along the horizontal work surface, a layer capable of static clinging to the flexible work support and the whiteboard. The static cling layer has permanent markings on one side, and a transparent layer over the permanent markings for repeated marking with the marker and removal of the marking from the transparent layer.

The disclosure also provides a method of work and display.

DESCRIPTION OF THE PREFERRED EMBODIMENTS

The illustrations and descriptions are for the purpose of describing embodiments of a work and display device and method and are not intended to limit the device or method to the particular embodiments shown or described.

Figure 1:
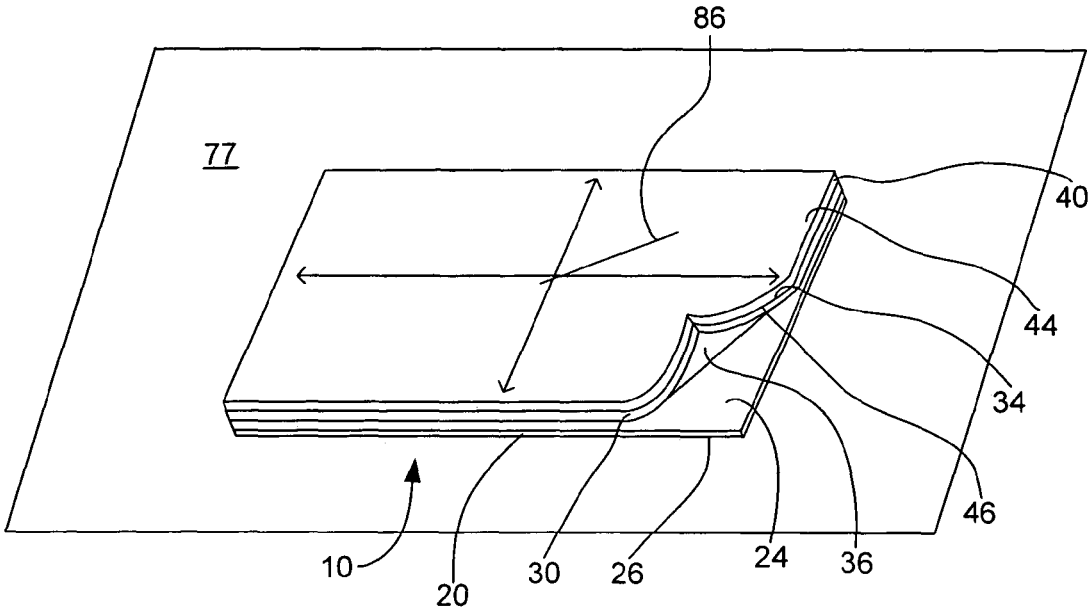
FIG. 1 is a side perspective view of a work and display device.

Accordingly, FIG. 1 shows an embodiment of a work and display device 10 in a work configuration with a front corner of a static cling material 30 turned up only for depiction purposes. The device 10 is otherwise shown in a work configuration and includes a flexible work support 20 and a layer of static cling material 30. The flexible work support 20 has smooth top 24 and bottom 26 surfaces. The bottom surface 26 of the support 20 is configured to slide along a conventional planar desk top 77, which contributes to the convenient and thus the desirability of using the device because it can be pivoted and moved about to provide access to its various regions. The support 20 may be constructed from a material such as paper, wood, plastic, combinations of the same, or other materials that provide smooth surfaces, or a coating can be applied to such a material to provide the smooth surface when desired.

The static cling material 30 may be a flexible vinyl layer including properties such that it will remain attached to the work support without fasteners such as adhesives, tacks, or the like, with a bottom surface 36 adjacent the top surface 24 of the support 20. Thus, the static cling material 30 is removable from the flexible support 20 by simply peeling the layer 30 away from the support 20. The opposite top side 34 of the static cling material 30 is adjacent a bottom surface 46 of a transparent coating 40, which may be a UV coating, that in turn has an opposing top surface 44 having properties such that it can receive erasable markings, such as the marking 86. The markings 86 shown are of the type made by a dry erase marker, and thus they can be wiped clean from the surface 44.

Figure 2:
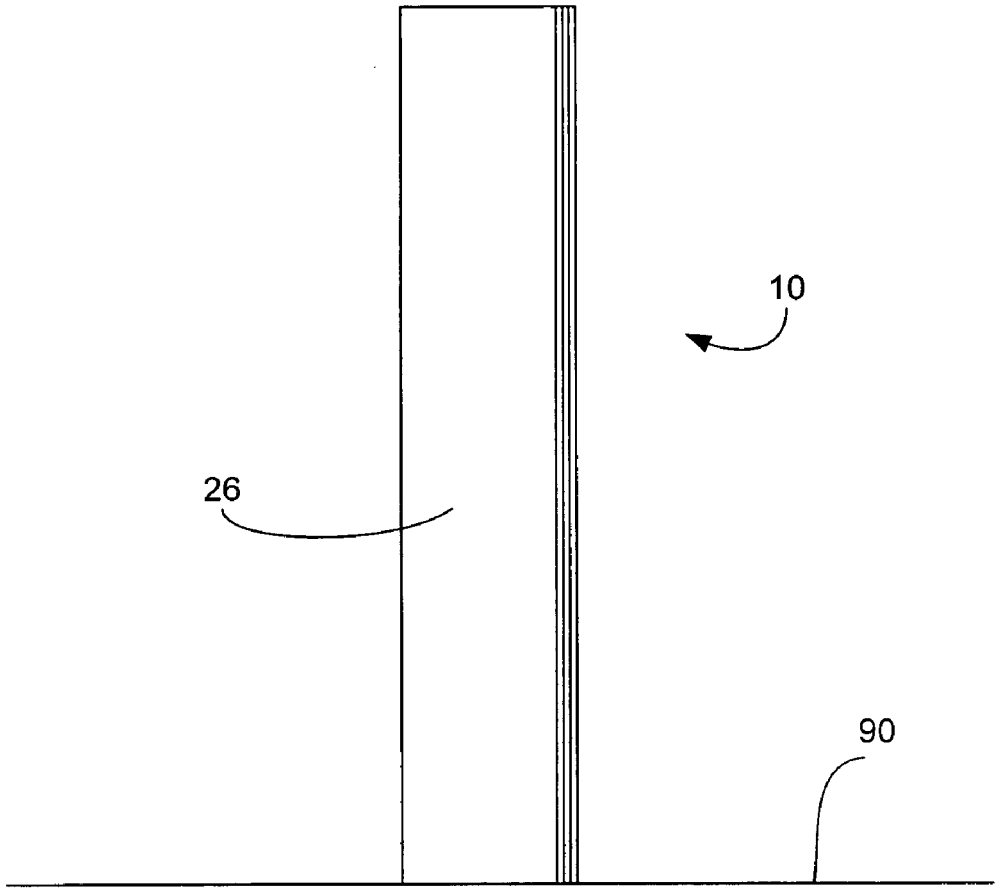
FIG. 2 is a side view of a work and display device in a storage and transport configuration.
Figure 7:
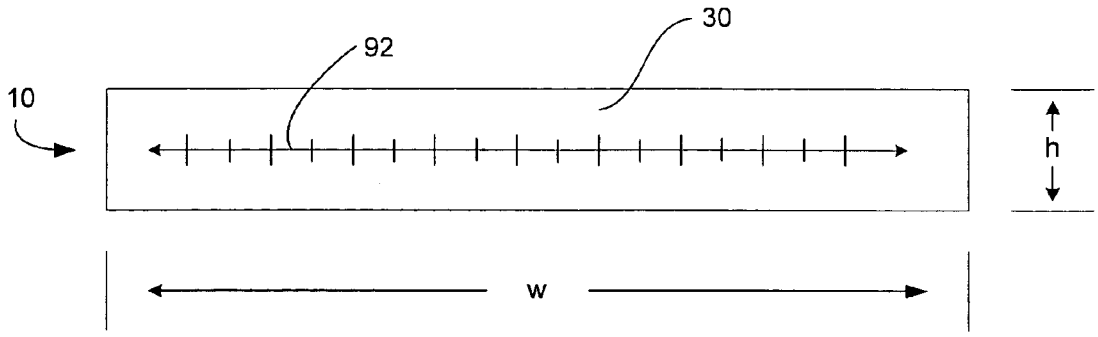
FIG. 7 is a front view of a work and display device.
Figure 8:
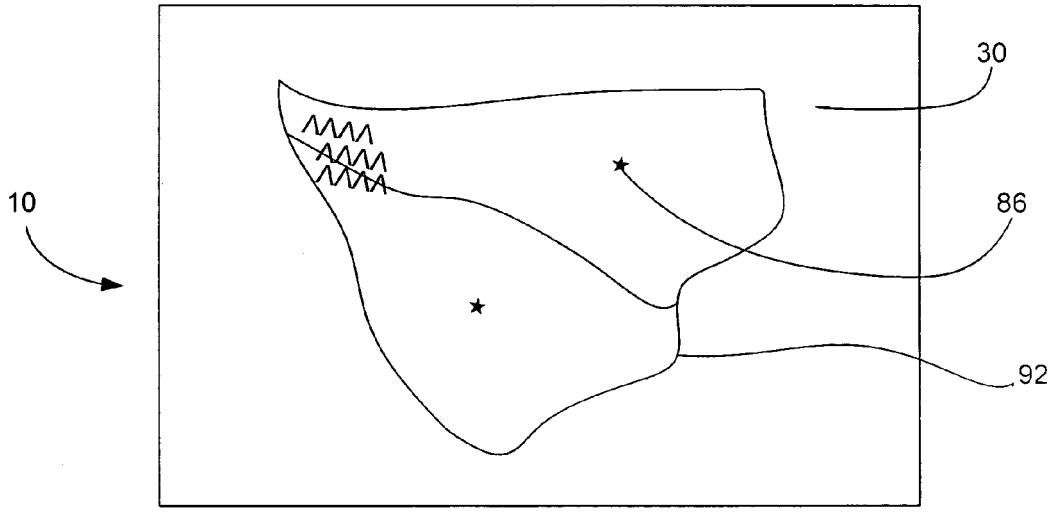
FIG. 8 is a front view of a work and display device.

FIG. 2 is a side view of the device 10 in a transportation and storage configuration. The device 10 is readily changeable from the work configuration shown in FIG. 1 to the transport and storage configuration shown in FIG. 7. In addition, the device 10 is rigid enough in the transport and storage configuration to stand on edge on a floor or other flat surface 90 in a self-supporting manner. Thus, the device 10 can be conveniently stored in the closet of a classroom or the like and easily retrieved for display.

Figure 3:
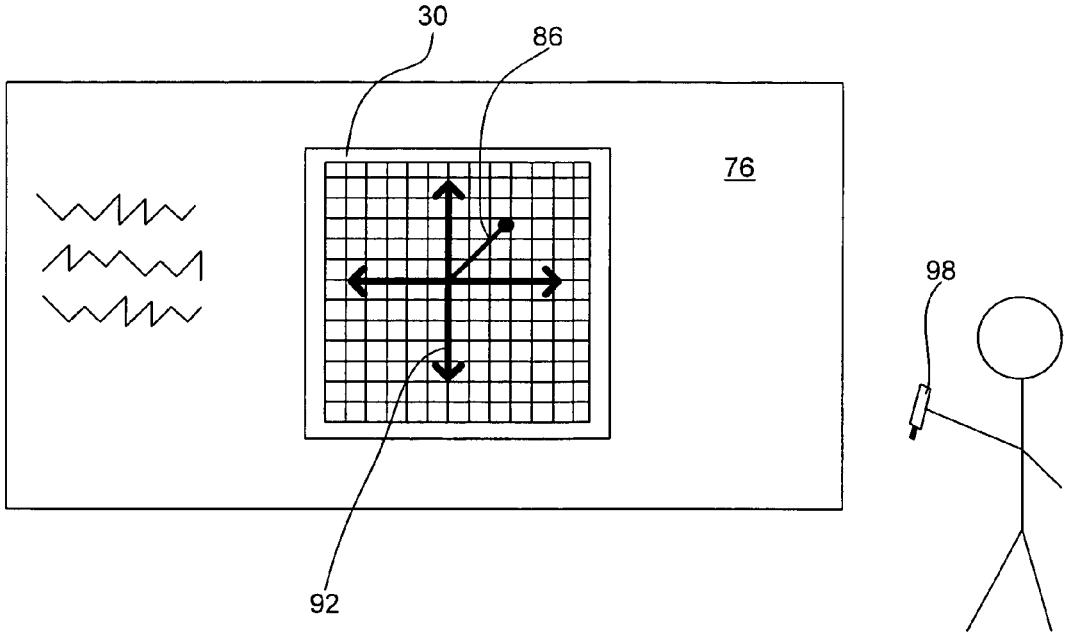
FIG. 3 is a front view of a work and display device.
Figure 4:
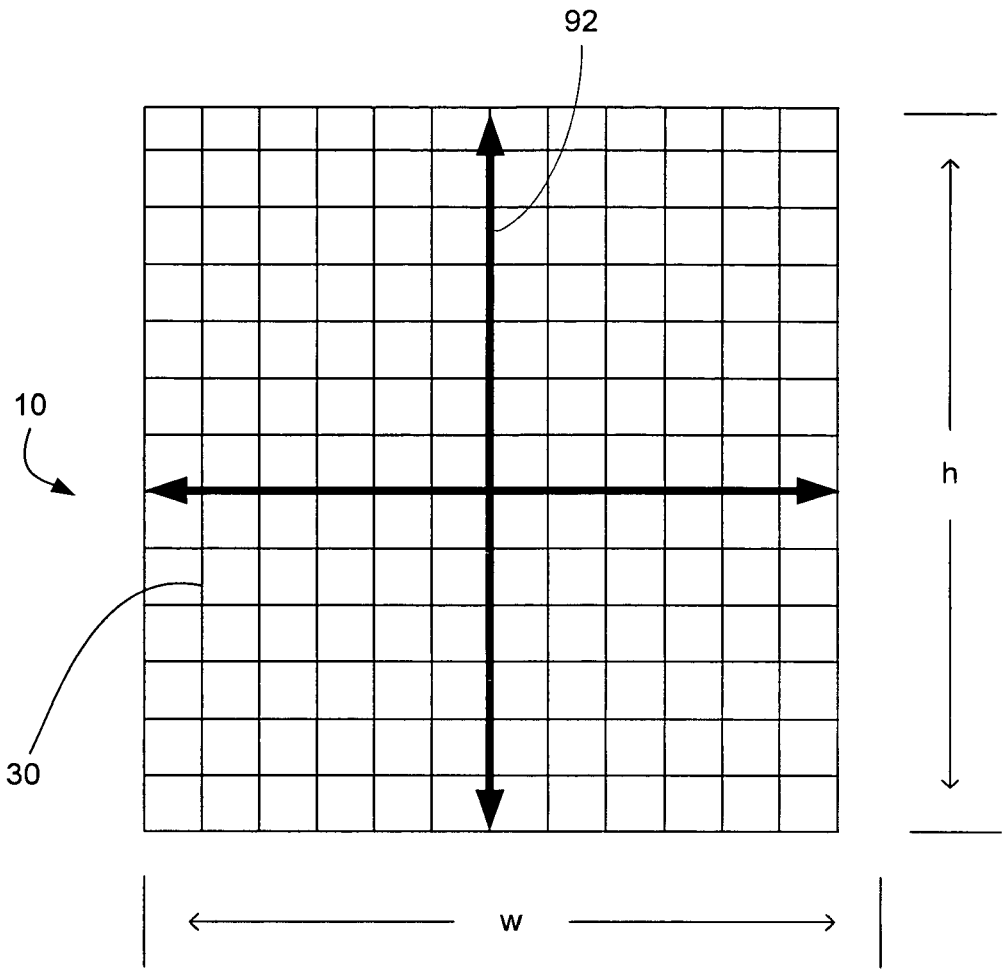
FIG. 4 is a front view of a work and display device.
Figure 5:
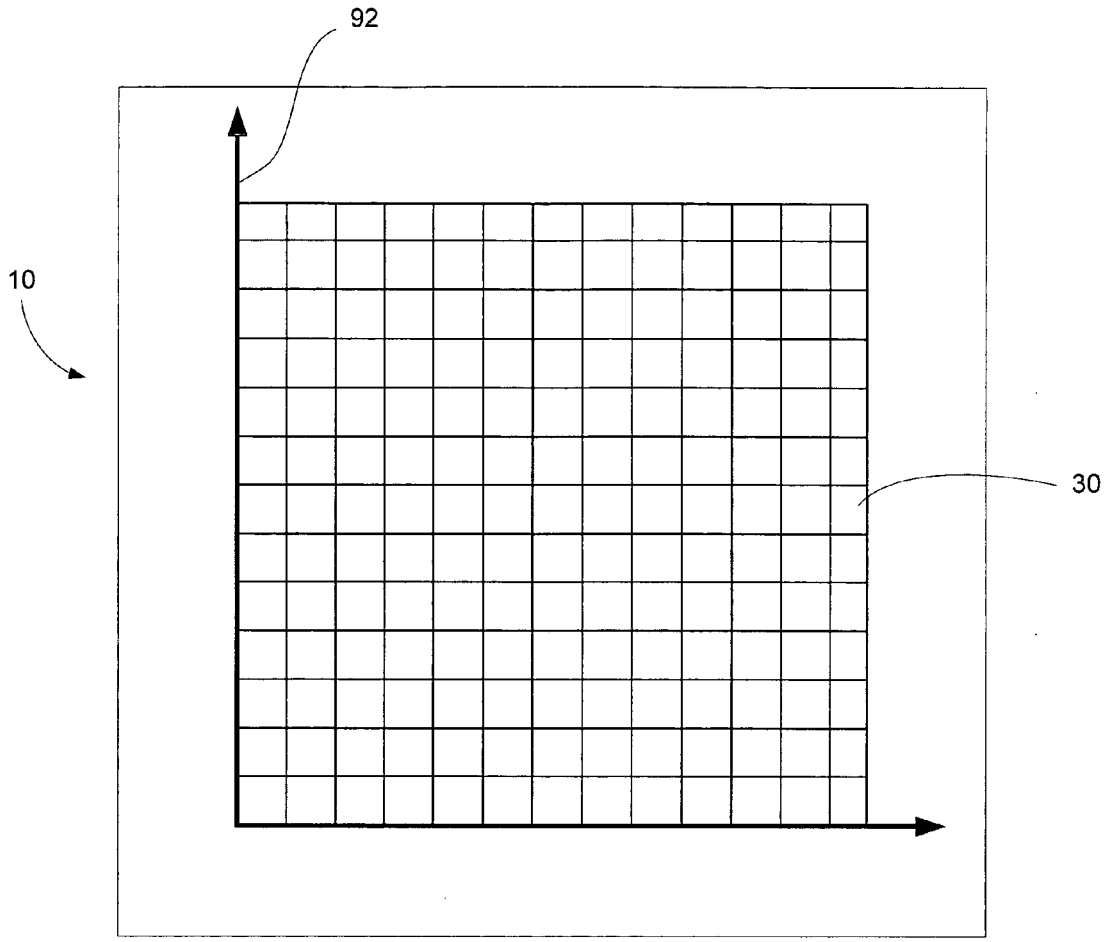
FIG. 5 is a front view of a work and display device.
Figure 6:
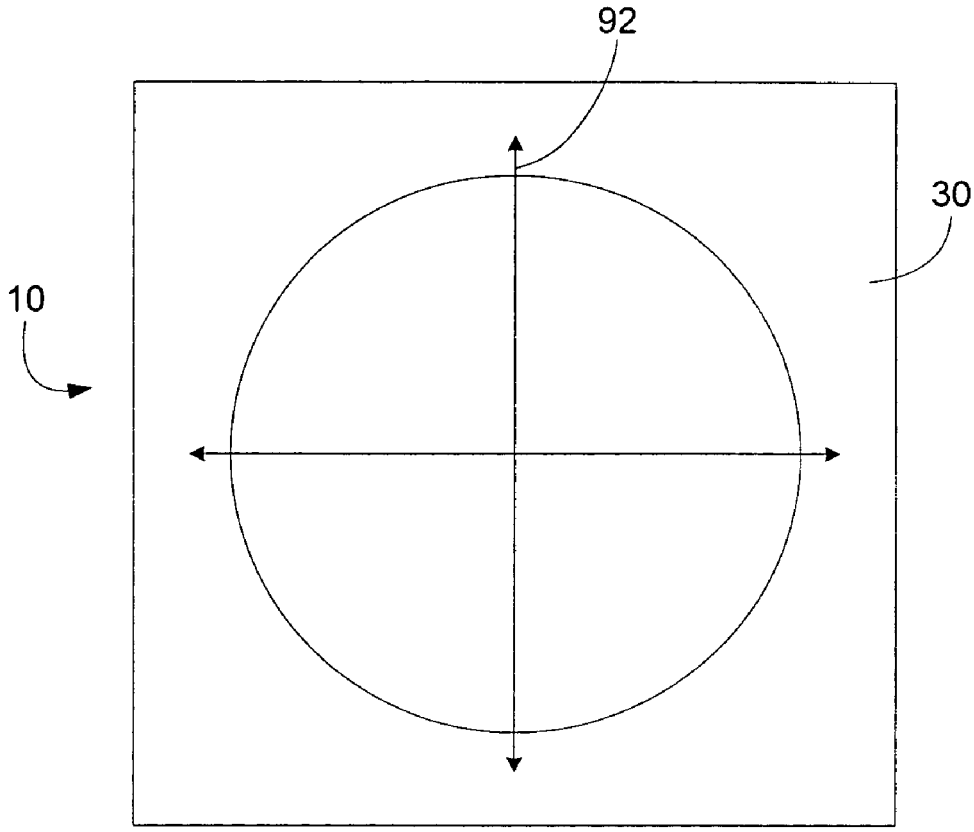
FIG. 6 is a front view of a work and display device.

FIG. 3 shows an example of display of the static cling material 30 of the device 10. The material 30 is removable from the work support 20 for attachment to a whiteboard 76 or wall, or like surface. A dry erase marker 98 can be used to mark the surface 44 of the transparent coating 40 on the static cling material 30 with the material 30 on the whiteboard 76.

FIGS. 4, 5, 6, 7 and 8 are each front views of embodiments of the work and display device 10 showing permanent markings 92 on the top of the static cling material. The markings 92 may be applied using an offset printing process. The markings 92 on the static cling material 30 are particularly useful for instructing students in a classroom, as the material is between about 20 and about 30 inches wide, and between about 20 and about 30 inches high in FIGS. 4, 5, 6, and 8. The material 30 is between about 30 inches and about 50 inches wide and between about 6 inches high and about 12 inches wide in the embodiment of the device shown in FIG. 7. The markings 92 may include one or more of parallel lines, perpendicular lines, circles, maps representing geographic regions, or various other shapes.

Certain modifications and improvements will occur to those skilled in the art upon a reading of the foregoing description of the device. All such modifications and improvements have not been included herein but may nonetheless fall properly within the scope of the appended claims.

I claim:

1. A work and display method comprising:

configuring a work and display device having a work support and a static cling material attached to the work support into a work configuration, placing the device on a planar surface of a table, marking on a coating on the static cling material with a marker, sliding the device about the planar surface, configuring the device into a transport and storage configuration, transporting the device, removing the static cling material from the flexible work support, attaching the static cling material to a whiteboard, marking on a surface of the coating on the static cling material, removing the static cling material from the whiteboard, attaching the static cling material to the work support, configuring the device into a transport and storage configuration, storing the device in a storage area, and transporting the device.

2. The work and display method according to claim 1 further comprising repeating the steps of claim 1.

* * * * *